US006685100B1

(12) United States Patent
Jang

(10) Patent No.: US 6,685,100 B1
(45) Date of Patent: Feb. 3, 2004

(54) RAIL CLIP FIXING IMPLEMENT

(75) Inventor: Young Gil Jang, 1-304 Dongmyung Villa, 4781-1 Sujin-2 dong, Sujung-gu, Sungnam, Kyunggi-do 462-182 (KR)

(73) Assignees: Young Gil Jang, Sungnam (KR); Gye Jun Lee, Seoul (KR)

( * ) Notice: Subject to any disclaimer, the term of this patent is extended or adjusted under 35 U.S.C. 154(b) by 0 days.

(21) Appl. No.: 10/111,465

(22) PCT Filed: Nov. 17, 2000

(86) PCT No.: PCT/KR00/01325

§ 371 (c)(1),
(2), (4) Date: Apr. 23, 2002

(87) PCT Pub. No.: WO01/36748

PCT Pub. Date: May 25, 2001

(30) Foreign Application Priority Data

Nov. 18, 1999 (KR) ..... P1999-51387

(51) Int. Cl.[7] ..... E01B 9/00
(52) U.S. Cl. ..... 238/310
(58) Field of Search ..... 238/351, 283, 238/349, 315, 294, 297, 310, 343, 282, 304, 323, 338, 377, 264, 265, 306

(56) References Cited

U.S. PATENT DOCUMENTS

| | | | | | |
|---|---|---|---|---|---|
| 1,319,618 | A | * | 10/1919 | Revis | 238/294 |
| 1,324,614 | A | * | 12/1919 | Nyman | 238/294 |
| 4,067,495 | A | * | 1/1978 | Qureshi | 238/349 |
| 4,073,435 | A | * | 2/1978 | Miller | 238/349 |
| 4,312,478 | A | * | 1/1982 | Matsuo et al. | 238/349 |
| 4,625,912 | A | * | 12/1986 | Fee | 238/349 |
| 4,718,604 | A | * | 1/1988 | Eisenberg et al. | 238/349 |
| 5,016,816 | A | * | 5/1991 | Lanham | 238/349 |
| 5,678,762 | A | * | 10/1997 | Wood et al. | 238/351 |
| 5,692,677 | A | | 12/1997 | Duconseil | 238/283 |

FOREIGN PATENT DOCUMENTS

| | | | | |
|---|---|---|---|---|
| GB | 2087460 | | 5/1982 | |
| GB | 2095311 | A * | 9/1982 | E01B/9/30 |
| JP | 61184704 | | 11/1986 | |
| WO | 9426977 | | 11/1994 | |

* cited by examiner

*Primary Examiner*—S. Joseph Morano
*Assistant Examiner*—Frantz F. Jules
(74) *Attorney, Agent, or Firm*—Ladas & Parry

(57) ABSTRACT

A rail clip fixing implement has a fixing portion having a fixing hole and an elongated hole with a horizontal cross-section length for insertion of insertion portions of a rail clip. An embedded portion extends downwardly from a lower portion of the fixing portion for embedding in a tie. A support horizontally extends between the fixing portion and the embedded portion for supporting a lower portion of a flange portion of a rail on the surface of the tie. The elongated hole is preferably slanted at an angle range of 0° to 90° in such a manner that the length of the cross section is formed in the direction of the rail.

4 Claims, 5 Drawing Sheets

RAIL CLIP FIXING IMPLEMENT

BACKGROUND OF THE INVENTION

1. Field of the Invention

The present invention relates to a rail clip fixing implement, and in particular to a rail clip fixing implement embedded in a precast concrete tie in a gravel railway and fixing a rail by pressing a flange portion of a rail.

2. Description of the Background Art

FIG. 1 is a cut-away disassembled perspective view of a railway illustrating a fixing implement of a rail embedded in a PC tie in the conventional art.

As shown therein, an upper plate member 2(base plate) formed of a metallic plate is engaged to a PC tie 1 installed in a concrete railway or a gravel railway by an engaging member 3 embedded in the PC tie 1, and a fixing plate 5 having a through fixing hole 4 is engaged to an upper plate member 2 by the engaging member 3(or fixed to the upper plate member 2 by a welding). One end of the clip 7 is inserted into the fixing hole 4, and the other end of the same tightly supports a pressurizing plate 9 mounted on the flange 8*a* of the rail 8 of the railway for thereby fixing the rail 8 of the railway. A flat shaped insulation pad 10 having an elastic force for absorbing a dynamic weight and vibration which occur in the vertical direction when a train repeatedly moves and decreasing the ground vibration is disposed between the rail 8 and the upper plate member 2.

Therefore, the vertical weight which occurs when a train moves along the rail 20, at a certain speed is transferred to the ground through the rail 8 and the PC tie 1, and the other end of the clip 7 which supports the flange 8*a* of the rail 8 and one end of the clip 7 inserted into the fixing hole 4 of the fixing plate 5 receive the weight in the vertical direction for thereby supporting the rail 8.

SUMMARY OF THE INVENTION

Accordingly, it is an object of the present invention to provide a rail clip fixing implement capable of supporting a flange of a rail when forming a concrete of a PC tie of a gravel railway, distributing a dynamic weight and vibration applied in a vertical and horizontal direction to three points and easily engaging a rail of a railway to a PC tie in such a manner that an engaging portion of a fixing implement to which the clip is fixed is embedded.

It is another object of the present invention to provide a rail clip fixing implement capable of enhancing a workability since an additional apparatus for installing a rail of a railway to a PC tie is not needed.

It is still another object of the present invention to provide a rail clip fixing implement capable of preventing a fixing implement from being separated from a PC tie due to a vertical weight and impact which are repeatedly generated when a train moves along a rail after a rail is installed on the PC tie using the fixing implement and minimizing a vibration and impact for thereby implementing a good environment around the railway and station.

To achieve the above objects, there is provided a rail clip fixing implement which includes a fixing portion having an elongated hole having a horizontal cross-section length into which an insertion portion of a rail clip is inserted, an embedded portion downwardly extended from a lower portion of the fixing portion and embedded in the tie, and a support horizontally extended between the fixing portion and the embedded portion for supporting a lower portion of the flange portion of the rail on the surface of the tie.

The elongated hole is arranged in parallel with respect to the rail.

The elongated hole is slanted at an angle range of 0° to 90° in such a manner that the length of the cross section is formed in the direction of the rail.

The slant angle of the elongated hole is 45°.

DETAILED DESCRIPTION OF THE PREFERRED EMBODIMENTS

Figure 1:
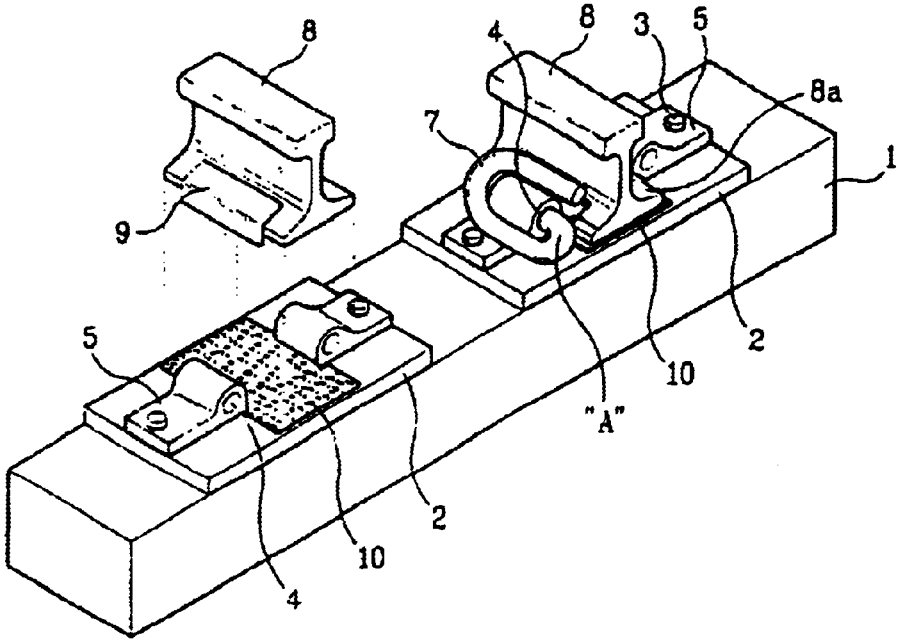
Fig. 1 PRIOR ART
FIG. 1 is a top/front/left-side perspective view of a conventional fixing implement with railway rails embedded in a PC tie, partly cut away and partly exploded.
Figure 2:
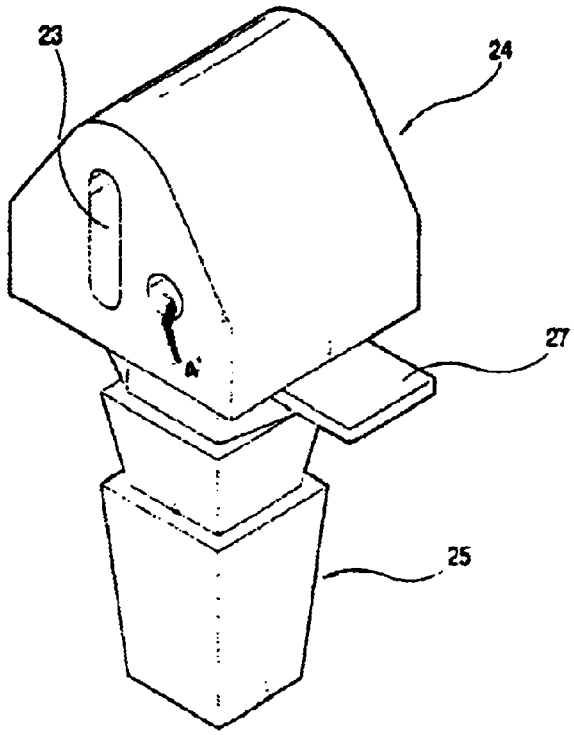
FIG. 2 is a top/front/left-side perspective view of a first embodiment of a rail fixing implement according to the present invention.

As shown in FIGS. 2 through 6, the present invention relates to a rail fixing implement having a certain shape in which a clip 22 is installed in a PC tie 21 on a gravel railway for thereby supporting a frange 20*a* at both sides of a rail 20.

The PC tie fixing implement includes a fixing portion 24 having an elongated hole 23 into which an insertion portion 22*a* of a clip 22 is inserted for thereby supporting the flange portion 20*a* of the rail 20, an embedded portion 25 integrally extended from the lower portion of the fixing portion 24 and embedded in the PC tie 21, and a support portion 27 protruded from a boundary portion between the fixing portion 24 and the embedded portion 25 and mounted at a lower portion of the flange 20*a* of the rail 20 and preventing a direct contact between the rail 20 and the PC tie 21 for thereby preventing an impact and vibration which is generated when a train runs along a rail from being transferred to the PC tie 21.

At this time, the elongated hole 23 receives the insertion portion 22*a* of the clip 22 for supporting the flange 20*a* of the rail 20 with respect to a pressurizing force in the vertical and horizontal directions when the train runs on the rail.

The embedded portions 25 are repeatedly forms in such a manner that the upper side is wide and the lower side is narrow for preventing the embedded portion 25 from being loosened from the PC tie 21 by a vertical weight and vibration which repeatedly occurs when the train runs on the rail.

In the drawings, reference numeral 28 represents a pressurizing plate capable of increasing a pressurizing force when pressing the flange 20*a* of the rail 20 by the pressing portion 22*b* of the clip, and 29 represents a buffering member disposed between the flange 20*a* of the rail 20 and the upper surface of the PC tie 21 for offsetting the impact and vibration an impact and vibration generated when the train runs on the rail and decreasing the impact and vibration transferred to the PC tie 21.

The operation of the rail clip fixing implement according to the present invention will be explained with reference to the accompanying drawings.

Figure 3:
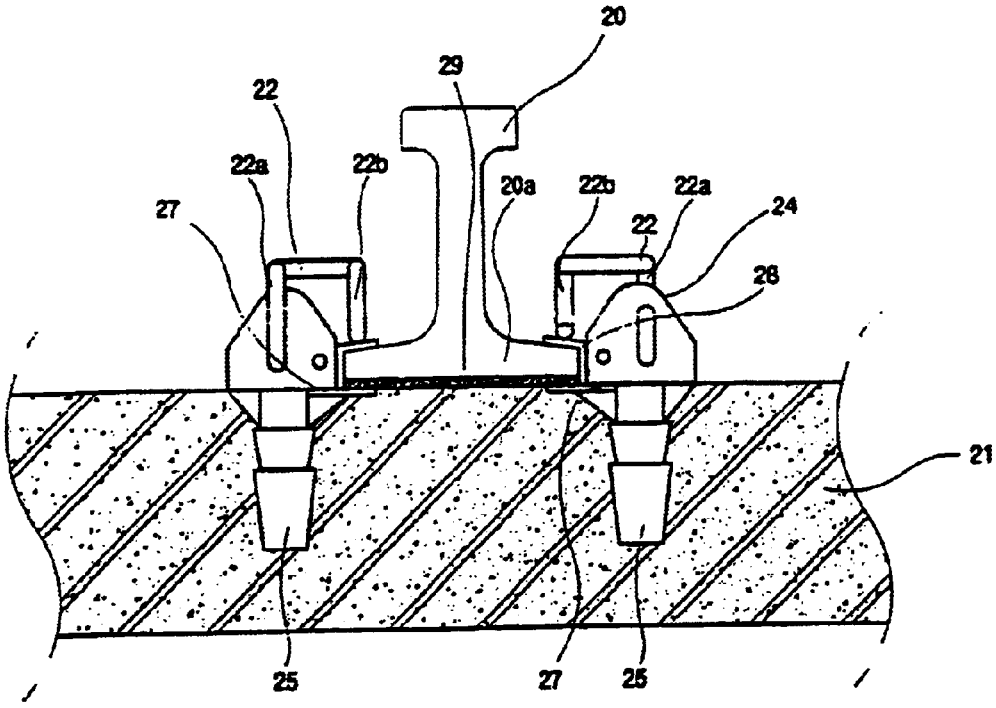
FIG. 3 shows right- and left-side elevational views of rail fixing elements according to FIG. 2 with rail, clip and tie members partly in section.
Figure 4:
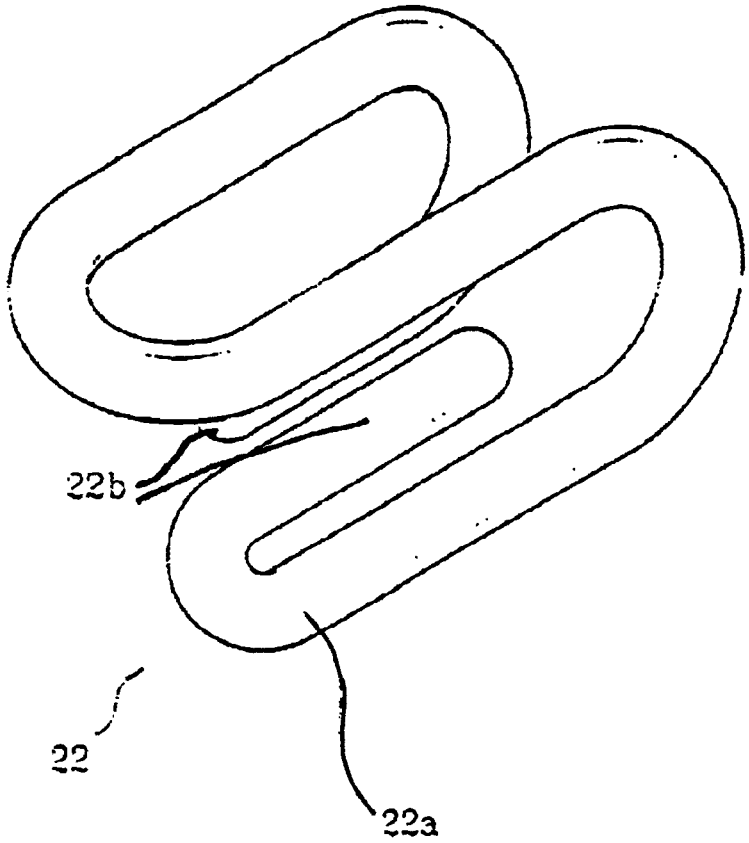
FIG. 4 is a top/rear/right-side perspective view of a clip of FIG. 3.

As shown in FIG. 3, the embedded portion 25 is repeatedly formed in the PC tie fixing implement when forming the concrete of the PC tie 21 in such a manner that the upper side is wide and the lower side is narrow, and the embedded portion 25 is embedded in a direction that a support 27 is formed at a boundary between the fixing portion 24 and the embedded portion 25 in the direction of the rail 20.

Therefore, the buffering member 29 is mounted between the fixing portions 24 of the left and right fixing implements which are fixed in such a manner that their supports 27 are embedded in the PC tie 21 in opposite directions. The rail 20 is installed on the buffering member 29, and then the insertion portions 22*a* of the clip 22 are inserted into the elongated hole 23 and fixing hole 4' of the fixing portion 24 with respect to the pressurizing force in the vertical and horizontal directions which is generated when the train runs on the rail. The pressurizing plate 28 which the pressurizing portion 22*b* of the clip 22 presses on the flange 20*a* of the rail 20 is, therefore, supported at three points.

Therefore, the fatigues repeatedly accumulated at the boundary of the repulsive force applied to the clip 22 in the upward direction when the train runs on the rail and the pressurizing force applied in the vertical direction are distributed by a three-point support for thereby increasing the life span of the clip 22.

Therefore, it is possible to significantly decrease the construction and manpower cost for installing the rail 20 of the railway.

Since the support 27 formed at a boundary between the fixing portion 24 of the fixing implement embedded in the PC tie 21 and the embedded portion 25 is mounted at a lower surface of the flange 20*a* of the rail 20, a direct contact between the rail 20 and the PC tie 21 is prevented, so that it is possible to prevent the vertical weight and vibration which are repeatedly generated when the train runs on the rail from being directly transferred to the PC tie 21.

The impact and vibration generated when the train runs on the rail are minimized, and the good environment around the rail and station is implemented.

Figure 5:
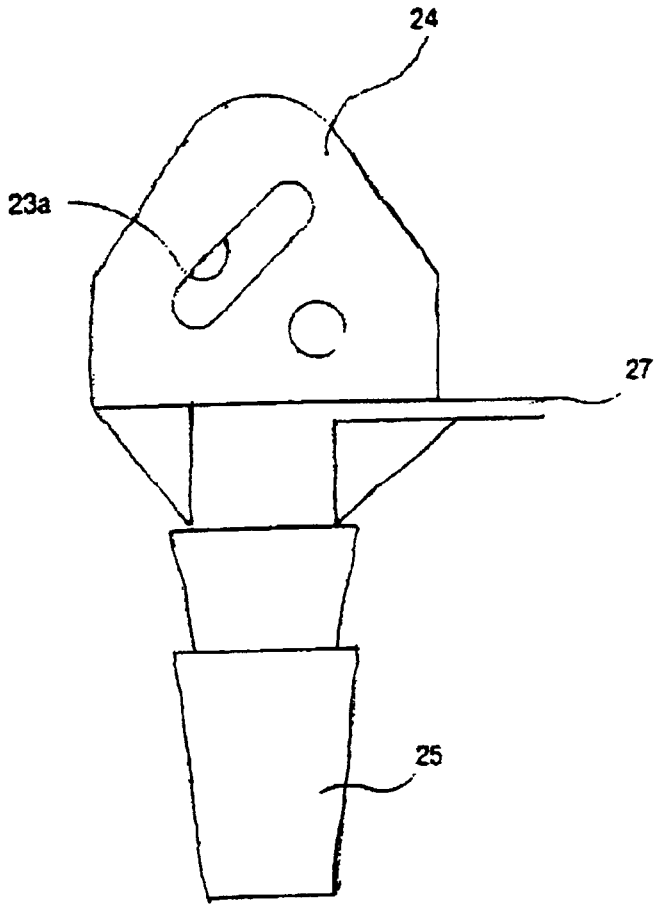
FIG. 5 is a left-side elevational view of a second embodiment of a rail fixing implement according to the present invention.

FIG. 5 is a view illustrating a rail clip fixing implement according to the present invention. The elongated hole 23*a* formed in the fixing portion 24 is slanted at a certain angle in a range from 0° to 90°. Preferably, the angle is 45°. At this time, the insertion portion 22*a* of the clip 22 inserted into the elongated hole 23*a* is slanted at an angle of 45°.

Figure 6:
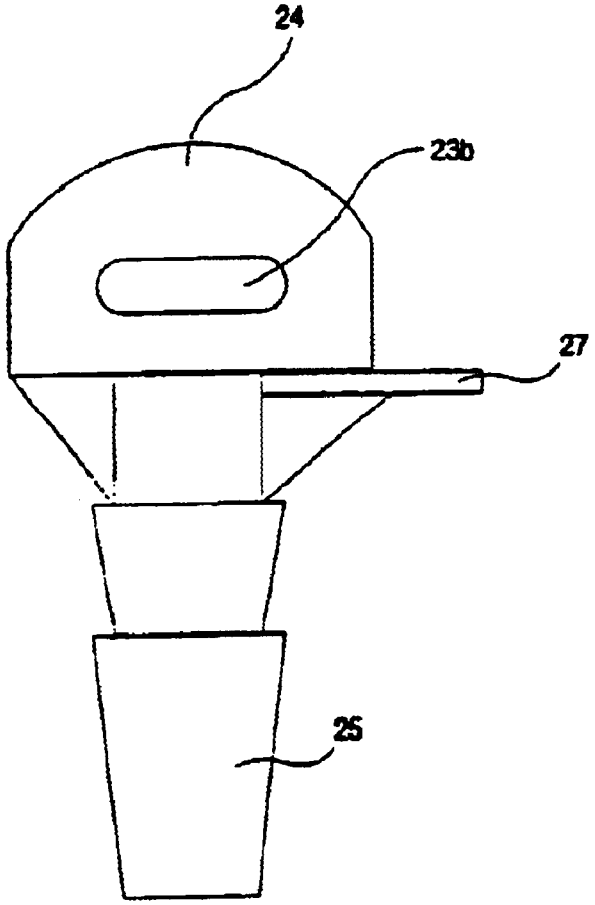
FIG. 6 is a left-side elevational view of a third embodiment of a rail fixing implement according to the present invention.

FIG. 6 is a view illustrating another example of a rail clip fixing implement according to the present invention.

As shown therein, the elongated hole 23*b* formed in the fixing portion 24 is horizontally formed in the direction the rail 1. At this time, the insertion portion 22*a* of the clip 22 inserted into the elongated hole 23*b* is slanted at an angle of 45°.

As described above, the flange of the rail is pressed and supported when forming the concrete PC tie on the gravel, and the embedded portion of the fixing implement to which the clip is fixed for distributing and offsetting the dynamic weight and vibration which are applied in the vertical and horizontal directions when the train runs on the rail to three points is embedded for thereby easily engaging the rail on the PC tie.

When installing the rail on the PC tie, an additional apparatus is not needed for thereby enhancing the workability.

The vibration and impact are minimized by preventing the fixing implement from being loosened due to a vertical weight and impact which are repeatedly generated when the train runs on the rail after the rail is installed on the PC tie using the fixing implement for thereby implementing a good environment around the rail and station.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a rail clip fixing implement having a fixing portion having a fixing hole for insertion of an insertion portion of a rail clip, the improvements comprising:

an elongated hole having a horizontal cross-section length in the fixing portion for insertion of another insertion portion of the rail clip;

an embedded portion downwardly extended from a lower portion of the fixing portion for embedding in a tie; and a support horizontally extended between the fixing portion and the embedded portion for supporting a lower portion of a flange portion of a rail on the surface of the tie.

2. The implement of claim 1, wherein said elongated hole is arranged in parallel with respect to the rail.

3. A rail clip fixing implement, comprising:

a fixing portion having an elongated hole having a horizontal cross-section length for insertion of an insertion portion of a rail clip;

an embedded portion downwardly extended from a lower portion of the fixing portion for embedding in a tie; and a support horizontally extended between the fixing portion and the embedded portion for supporting a lower portion of a flange portion of a rail on the surface of the tie, wherein said elongated hole is slanted at an angle range of 0° to 90° in such a manner that the length of the cross section is formed in the direction of the rail.

4. The implement of claim 3, wherein said slant angle of the elongated hole is 45°.

* * * * *